US010285453B2

(12) United States Patent
der Hoeven

(10) Patent No.: US 10,285,453 B2
(45) Date of Patent: May 14, 2019

(54) BRASSIERE INCLUDING A SUPPORT EDGE STARTING UNDERNEATH THE CUP TO RISE TO THE REAR ATTACHMENT OF THE STRAP

(71) Applicant: Hanes Operations Europe SAS, Rueil-Malmaison (FR)

(72) Inventor: Manon Turlan-Van der Hoeven, Marmagne (FR)

(73) Assignee: Hanes Operations Europe SAS, Rueil-Malmaison (FR)

( * ) Notice: Subject to any disclaimer, the term of this patent is extended or adjusted under 35 U.S.C. 154(b) by 186 days.

(21) Appl. No.: 15/539,324

(22) PCT Filed: Dec. 18, 2015

(86) PCT No.: PCT/IB2015/059798
§ 371 (c)(1),
(2) Date: Jun. 23, 2017

(87) PCT Pub. No.: WO2016/103134
PCT Pub. Date: Jun. 30, 2016

(65) Prior Publication Data

US 2017/0354189 A1 Dec. 14, 2017

(30) Foreign Application Priority Data

Dec. 23, 2014 (FR) ..... 14 63244

(51) Int. Cl.
*A41C 3/00* (2006.01)

(52) U.S. Cl.
CPC ..... *A41C 3/0021* (2013.01); *A41C 3/0057* (2013.01)

(58) Field of Classification Search
CPC ..... A41C 3/0057; A41C 3/0021
(Continued)

(56) References Cited

U.S. PATENT DOCUMENTS 1,815,697 A * 7/1931 Bauckman ..... A41C 3/00 450/85
1,822,872 A * 9/1931 Alexander ..... A41C 3/0021 450/68

(Continued)

FOREIGN PATENT DOCUMENTS

CN 1713830 A 12/2005
CN 101336753 A 1/2009

(Continued)

OTHER PUBLICATIONS

Chinese First Office Action in Chinese Application No. 2015800705147, dated Apr. 26, 2018, 16 pages.

(Continued)

*Primary Examiner* — Gloria M Hale
(74) *Attorney, Agent, or Firm* — Fish & Richardson P.C.

(57) ABSTRACT

A brassiere includes two cups attached by a central link, a lateral band affixed onto a side of each cup and terminating at a central rear hook, and a strap supporting an upper part of each cup. Each strap extends forward via an internal reinforcement edge meeting the central link and via an external reinforcement edge separate from the cup forming an upper contour of the lateral band. A support edge, starting underneath the cup, extends outwardly, rising continuously to terminate at a rear attachment point of the strap, where the support edge forms an upper contour of a support piece independent of the lateral band.

27 Claims, 2 Drawing Sheets

(58) Field of Classification Search
USPC ..... 450/59–64, 83–87
See application file for complete search history.

(56) References Cited

U.S. PATENT DOCUMENTS

| | | | | | |
|---|---|---|---|---|---|
| 1,923,821 | A * | 8/1933 | Gudeman | A41C 3/00 | 450/85 |
| 2,067,379 | A * | 1/1937 | Cristofanetti | A41C 3/00 | 450/85 |
| 2,255,720 | A * | 9/1941 | Lewis | A41C 3/00 | 450/86 |
| 2,486,414 | A * | 11/1949 | Sayers | A41C 3/0021 | 450/59 |
| 2,533,060 | A * | 12/1950 | Silvain | A41C 3/00 | 450/42 |
| 2,542,881 | A * | 2/1951 | Ries | A41C 3/0078 | 450/59 |
| 2,949,916 | A * | 8/1960 | Paveza | A41C 3/00 | 450/27 |
| 3,157,182 | A * | 11/1964 | Fridolph | A41C 3/00 | 450/27 |
| 3,304,940 | A * | 2/1967 | Holscher | A41C 3/00 | 450/59 |
| 3,710,800 | A * | 1/1973 | Carey | A41C 3/00 | 450/64 |
| 4,254,777 | A * | 3/1981 | Johnston | A41C 3/142 | 450/41 |
| 4,470,419 | A * | 9/1984 | DiTullio | A41C 3/00 | 450/19 |
| 8,758,082 | B1 * | 6/2014 | Woods | A41C 3/04 | 450/1 |
| 8,777,692 | B2 * | 7/2014 | Jimenez | A41C 3/00 | 450/30 |
| 2005/0221718 | A1 * | 10/2005 | Falla | A41C 3/0021 | 450/66 |
| 2010/0022165 | A1 * | 1/2010 | Silverman | A41C 3/0021 | 450/65 |
| 2011/0081827 | A1 * | 4/2011 | Williams | A41C 3/0021 | 450/65 |
| 2012/0244782 | A1 | 9/2012 | Pundyk | | |
| 2014/0162531 | A1 * | 6/2014 | Mazourik | A41C 3/0028 | 450/86 |

FOREIGN PATENT DOCUMENTS

| | | | |
|---|---|---|---|
| CN | 101574169 | A | 11/2009 |
| CN | 201352954 | A | 12/2009 |
| CN | 201356065 | A | 12/2009 |
| CN | 201657780 | A | 12/2010 |
| FR | 2945182 | A1 | 11/2010 |
| JP | H09-324305 | | 12/1997 |
| UZ | 2191 | | 8/2002 |
| WO | WO2009100407 | A2 | 8/2009 |

OTHER PUBLICATIONS

Korean Office Action in Korean Application No. 10-2017-7020336, dated Jun. 26, 2018, 11 pages.
PCT International Search Report and Written Opinion of the International Searching Authority, PCT/IB2015/059798, dated Mar. 2, 2016, 11 pages.
International Preliminary Report on Patentability in International Application No. PCT/IB2015/059798, dated Jun. 27, 2017, 8 pages.
Australian Office Action in Australian Application No. 2015370503, dated Nov. 24, 2017, 2 pages.
New Zealand Office Action in New Zealand Application No. 733000, dated Dec. 8, 2017, 2 pages.

* cited by examiner

BRASSIERE INCLUDING A SUPPORT EDGE STARTING UNDERNEATH THE CUP TO RISE TO THE REAR ATTACHMENT OF THE STRAP

CROSS-REFERENCE TO RELATED APPLICATION(S)

This application is a U.S. National Phase Application under 35 U.S.C. § 371 and claims the benefit of priority to International Application Serial No. PCT/IB2015/059798, filed Dec. 18, 2015, which claims priority to French International Application Serial No. 14/63244, filed Dec. 23, 2014, the contents of which are hereby incorporated by reference.

TECHNICAL FIELD

The present disclosure concerns a woman's under-garment which constitutes a brassiere.

BACKGROUND

Brassieres include two cups which receive the breasts, designed to support and keep them in shape.

One type of known brassiere currently in use includes a cup support including a central link in front between said cups, and an upper support for each cup by means of a strap passing over the shoulder, as well as lateral guidance by means of a lateral band starting at the bottom of said cup, passing under the arm, and joining the band from the other side by means of a central hook disposed at the back. The rear end of each strap is affixed in back on each lateral band.

Each cup also includes differentiation of the support functions, including height maintenance at the upper part by means of the strap and, toward the bottom on each side, lateral support offered in the middle by the central link to the other cup and on the side by means of the lateral band affixed in back to the other band. With the said lateral supports of the two cups, a belt encircling the woman's bust is obtained, which achieves a covering of cups on the chest.

As an extra benefit, the cups can include a semi-rigid frame following the lower contour, which passes below the breasts so as to provide a particular curve in three dimensions. Two simple, independent frames can be used for the two cups, or one common, double frame which includes the central link. The frames can be metal, in particular, or made of a plastic material.

Brassieres must respond to numerous constraints, which are sometimes difficult to reconcile, including, in particular, adaptation to different morphologies, effective support of the breasts, great comfort while particularly avoiding large local forces that could bother, irritate, or injure, and an esthetic quality, including a curve that shows off the breasts.

One problem which arises is that a thin strap is generally used on each side, hanging on top of the cup, and a lateral band affixed directly to the side of the cup at its lower part, which generates tensions in the cup between said two points of attachment, which are capable of setting up points of unpleasant compression on the body.

Another problem which arises is that of providing a facing for the central part in front of the brassiere on the chest between the breasts, so that the cups are not far away therefrom, in order to ensure support which gives the desired curve to the breasts without a frame, or with a thin, light frame, so as to maintain great comfort as well as good flexibility without hindering movement.

SUMMARY

The present disclosure aims in particular to avoid said drawbacks of prior art.

A brassiere is proposed for this purpose including two cups attached to one another by a central link, which includes on each side a lateral band affixed to the side of the cup, which terminates rearward with a central, rear hook for the bands to catch one another, as well as a strap supporting the upper part of the cup in front, being distinguished in that each strap extends forward via an internal reinforcement edge which joins the central link, and via an elongated, external reinforcement edge of the cup, forming the upper contour of the band which extends, continuously descending, to meet up with the hook, said band rising to the top of the cup between the external edge and said cup, the brassiere, furthermore including a support edge which, starting underneath the cup, extends outward, rising continuously to terminate at the attachment point of the strap, this support edge forming the upper contour of a support piece independent of the band.

One advantage of said brassiere is that the external reinforcement edge, some distance from the cup by means of the elastic fabric of the band and descending continuously, as well as the support edge underneath the cup extending to the exterior while continuously rising, and its support piece, constitute effective means of supporting the weight of the breast, including good distribution of the forces between them, which avoids the uncomfortable local tensions of the brassiere and provides great springiness to the assembly, maintaining the curves desired.

The brassiere according to the disclosure can moreover include one or several of the following characteristics, which can be combined with one another.

Advantageously, the brassiere includes a lower reinforcement edge which continuously lines the lower side of the two bands.

Advantageously, the lower edge also lines the lower side of the support pieces. Thus the lower part of said support piece is reinforced in a simple manner without adding raised edging.

Advantageously, the support edge bounding the upper side of the support piece extends beyond the rear attachment by means of a rear edge which descends in a symmetric curve to the rear hook. Thus a distribution of forces at the back is obtained which renders the rear attachment of the straps comfortable.

In particular, the support edge and the support piece can be disposed on the front side of the band, but they can also be disposed on its back side.

Advantageously, each cup includes an encircling border beginning at the central link, which follows its lower contour and then its exterior contour to end by meeting the interior edge at a junction point. Said encircling border accomplishes reinforcement of the cup contour.

According to one embodiment, the central link includes a small horizontal, upper edge separating the said two cups.

According to another embodiment, the said two interior edges meet at the central link in a parallel manner.

According to another embodiment, said two interior edges cross at the central link at an angle of about 90°.

According to another embodiment, each interior edge forms an angle at the junction point with an encircling border of the cup.

These different embodiments each offer a particular technique for connecting the edges to one another.

BRIEF DESCRIPTION OF THE DRAWINGS

The disclosure will be better understood and other advantages will appear more clearly upon reading the description given hereinafter by way of example, referring to the drawings attached, wherein.

DETAILED DESCRIPTION

Figure 1A:
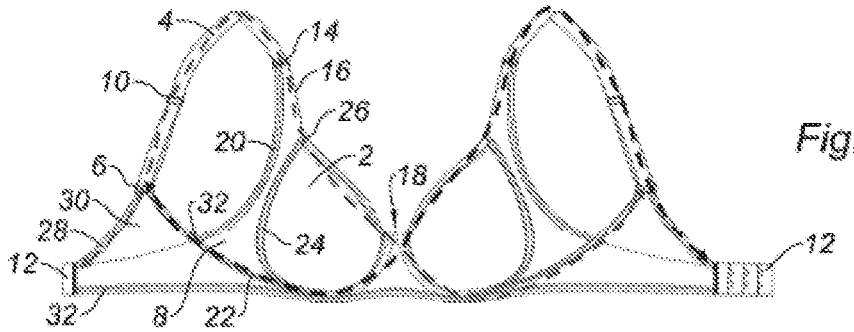
FIGS. 1*a* and 1*b* are drawings of a brassiere according to the disclosure, laid flat and exhibiting, respectively, the front side and the back side.
Figure 1B:
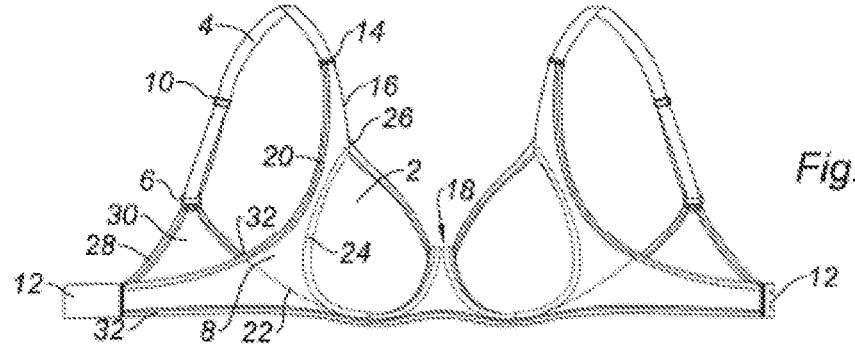

FIGS. 1*a* and 1*b* exhibit a brassiere symmetric to the central vertical axis, including on each side a strap 4 the forward end of which supports the upper part of a cup 2, the rear end passing into a buckle 6 forming a rear point of attachment before rising to terminate at a height-adjustment hook 10.

A lateral band 8 starting at the exterior side of cup 2 passes underneath the person's arm and going to the middle of the back terminates with a hook 12, which is fastened to a complementary hook 12 of the band form the other side.

The front end of strap 4, including a forward attachment point 14 coming over the shoulder, then extends downward via an interior reinforcement edge 16, which meets a point at the top of cup 2, then continues to form the interior border of said cup, and finally terminates at a central link 18 between the two cups.

The front end of strap 4 also extends downward past forward attachment point 14 via an exterior reinforcement edge 20, which remains some distance from cup 2, coming close to it and then moving away, to form, by continuous descent in a symmetric curve, the upper border of lateral band 8, which reaches hook 12 roughly horizontally.

A lower reinforcement edge 32 of the brassiere continuously lines the lower side of the two bands 8, one hook 12 joining to the other in a direction that remains roughly horizontal.

Each cup 2 includes an encircling border 24, which commences at central link 18 and follows the lower contour and then the exterior contour of said cup, to end by meeting interior edge 16 at junction point 26.

The two interior ends of the two encircling borders 24 terminate by coming roughly parallel to one another, which forms a small, upper horizontal edge separating the two cups 2 at central link 18.

Each band 8 is bounded above by exterior edge 20, below by lower edge 32, and inward by the encircling border 24. Each band 8 consists of a rear part, a lateral, roughly horizontal part, and a front part which rises in between the exterior edge 20 and the encircling border 24, leaving a small intermediate space between them, and terminates on top of the forward attachment point 14.

Each cup 2 includes a support edge 22 disposed on the front (outer) side of the band 8, which begins below said cup, being superposed on the encircling border 24, and then extends outward, rising in a symmetrical curve up to the rear attachment point 6.

A support piece 30 bounded above by support edge 22 is disposed on the front (outer) side, said piece rising symmetrically rearward up to rear attachment point 6, and past that attachment point via a rear edge 28 which descends again in a symmetrical curve to end at hook 12, forming a point, also called a "chimney" shape. The support piece 30 is bounded below by the lower edge 32.

Exterior edge 20 and support edge 22 cross at a point 32, which is located at the person's side under the arm.

The fabric of the cups 2 is relatively rigid, its material being prevented from deforming, so as to force the breasts into a shape along a particular curve shaped in the fabric.

Straps 4, as well as edges 16, 20, 22, 28, 32 and border 24 act with relatively reduced elasticity so as to offer support from the various fabrics of the brassiere.

The fabric of the bands 8 and support pieces 30 constitutes an elastic fabric, having a springiness specially designed to recover to its starting point after stretching, with no deformation.

Through its elasticity, each band 8 then constitutes, with its forward part rising to strap 4 and extended along the entire side of relatively rigid cup 2, an effective support of said cup, which distributes the support force over a large part of said cup.

Furthermore, support edge 22 with its support piece 30 rising rearward and supported by rear attachment point 6 of strap 4, also gives support to cup 2 with a distribution of forces which effectively supplements that of band 8.

Support of cup 2 is also obtained through the two independent fabrics of band 8 and of support piece 30, which can move together, which gives the assembly great flexibility. Said two fabric pieces 8, 30 are themselves supported by the lines of force marked by the dashed lines, which go around inside each cup 2, and both rising upward and outward, which distributes the weight of the breast along two lines, avoiding a concentration of forces on strap 4 whereby this is usually accomplished.

Then no pressure is concentrated at any specific point of cup 2, which could cause large deformations at that location or any discomfort to the person's body that would be unpleasant. Moreover, the distribution of forces and pulls on the two fabric pieces 8, 30 allows the weight applied by straps 4 on the shoulders to be lightened, which avoids the skin being marked by the elastic edges of said straps.

This type of brassiere is particularly attractive as a sports bra, offering a lot of support while still allowing great freedom of movement with an elevated level of comfort.

As an extra benefit, if necessary, the brassiere can accommodate a single frame underneath cups 2, or two independent frames, which can be completed by going around each cup or can be reduced, forming only a half-encirclement. It will be noted that with the efficient support of edges and of independent fabrics arranged according to the disclosure, said frames can exhibit a reduced section compared with what is usually used, in order to offer only a support supplement. The frames are then less annoying.

Figure 2A:
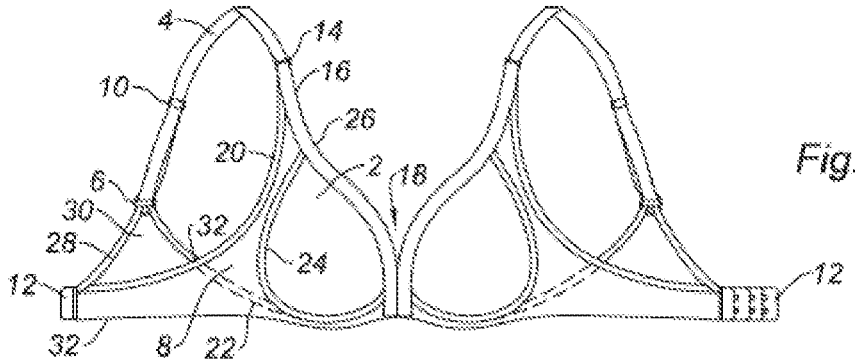
FIGS. 2*a* and 2*b* are drawings of a brassiere according to a first variant, exhibiting, respectively, the front side and the back side.
Figure 2B:
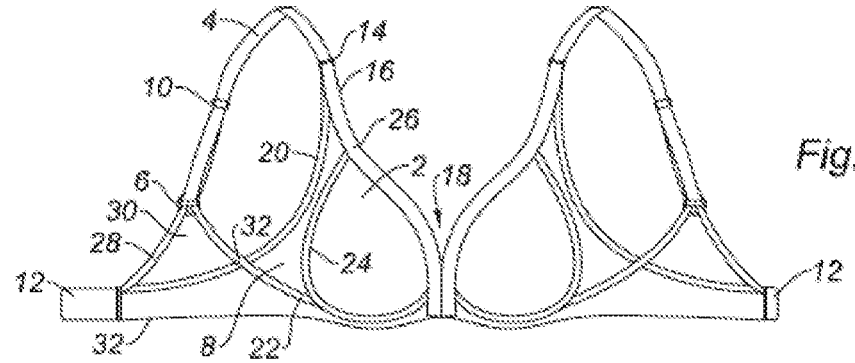

FIGS. 2*a* and 2*b* depict similar brassieres, including as a variant support edge 22 as well as support piece 30, which are disposed on the back side of band 8.

Furthermore, the two interior edges 16 meet at the central link 18 in a parallel manner and terminate at the lower edge 32. This arrangement provides a technique for connecting interior edges 16 which is different, as well as a particular esthetic quality.

Figure 3A:
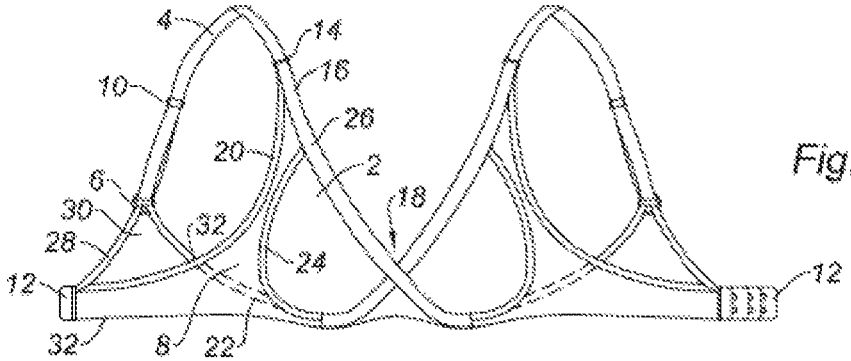
FIGS. 3*a* and 3*b* are drawings of a brassiere according to a second variant, exhibiting, respectively, the front side and the back side.
Figure 3B:
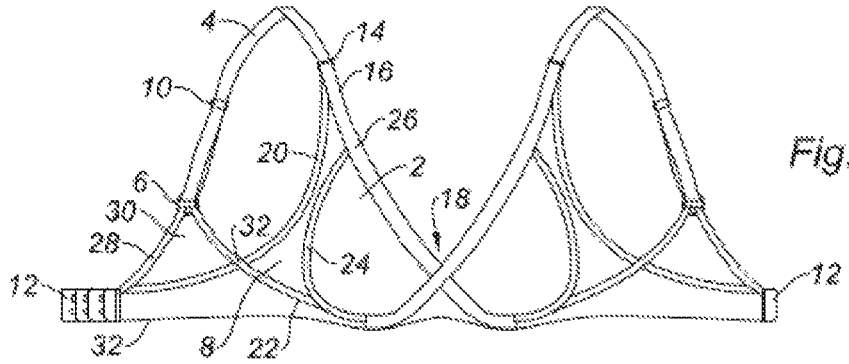

FIGS. 3*a* and 3*b* depict similar brassieres including as a variant the two interior edges 16 which cross at central link 18 at an angle of about 90° and each of which extends to form the starting point of support edge 22.

A brassiere is obtained which exhibits similar qualities, with another technique for connecting interior edges 16.

Figure 4A:
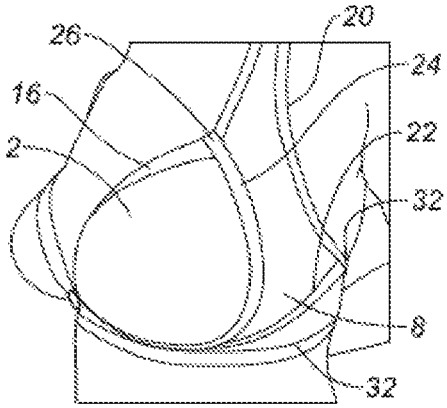
FIGS. 4*a* and 4*b* are drawings of a brassiere worn on a person, according to a third variant, exhibiting, respectively, the front side and the back side.
Figure 4B:
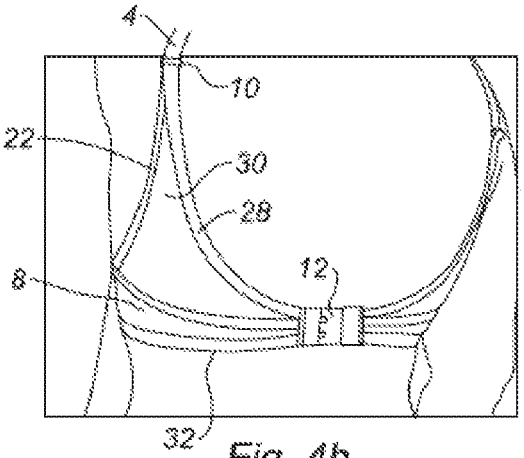

FIGS. 4*a* and 4*b* depict a similar brassiere, including as a variant interior edge 16 which forms an angle at junction point 26 with the encircling border 24, so as to obtain a star-like shape around said junction point.

A brassiere is likewise obtained exhibiting similar qualities, with another technique for connecting each interior edge 16 to encircling border 24.

As an extra benefit, any type of fabric usually used for these products can be used on the brassieres according to the disclosure, which can include different layers or surface coatings added on, such as, for example, a layer of silicone, in order to provide appropriate shapes and elasticities locally.

The invention claimed is:

1. A brassiere comprising:

two cups attached to one another by a central link, a lateral band affixed onto a side of each cup of the two cups, the lateral band of each cup terminating rearward with a central rear hook for attaching ends of the lateral bands to one another, a strap supporting an upper part of each cup of the two cups in a front of the respective cup, wherein the strap of each cup extends forward via an internal reinforcement edge meeting the central link and via an external reinforcement edge separate from the cup forming an upper contour of the lateral band which extends, descending continuously to the central rear hook, the lateral band rising upward to a top of the cup between the external reinforcement edge and said cup, and a support edge which, starting underneath the cup, extends outwardly, rising continuously to terminate at a rear attachment point of the strap, the support edge forming an upper contour of a support piece independent of the lateral band.

2. The brassiere according to claim 1, comprising a lower reinforcement edge which continuously lines a lower side of the lateral bands.

3. The brassiere according to claim 2, wherein the lower edge also lines a lower side of the support pieces of the two cups.

4. The brassiere according claim 1, wherein the support edge lining the upper contour of the support piece extends beyond the rear attachment point of the strap by a rear edge that descends in a symmetrical curve to the central rear hook.

5. The brassiere according to claim 1, wherein the support edge and the support piece are disposed on an outer side of the lateral band.

6. The brassiere according to claim 1, wherein each cup of the two cups includes an encircling border on each side of the two cups, commencing at the central link, which follows a lower contour of each cup and then an exterior contour of each cup, to end by meeting the internal reinforcement edge at a junction point.

7. The brassiere according to claim 1, wherein the central link includes a small, horizontal, upper edge separating the two cups.

8. The brassiere according to claim 1, wherein the internal reinforcement edges of the two cups meet at the central link in a parallel manner.

9. The brassiere according to claim 1, wherein the two internal reinforcement edges cross at the central link at an angle of about 90°.

10. The brassiere according to claim 6, wherein the internal reinforcement edge of each cup forms an angle at the junction point with the encircling border.

11. The brassiere according to claim 4, wherein the support edge and the support piece are disposed on an outer side of the lateral band.

12. The brassiere according to claim 4, wherein each cup of the two cups includes an encircling border on each side of the two cups, commencing at the central link, which follows a lower contour of each cup and then an exterior contour of each cup, to end by meeting the internal reinforcement edge at a junction point.

13. The brassiere according to claim 6, wherein the central link includes a small, horizontal, upper edge separating the two cups.

14. The brassiere according to claim 6, wherein the internal reinforcement edges of the two cups meet at the central link in a parallel manner.

15. The brassiere according to claim 6, wherein the two internal reinforcement edges cross at the central link at an angle of about 90°.

16. The brassiere according to claim 1, comprising a surface layer of silicone on fabric of the brassiere.

17. The brassiere according to claim 1, wherein the external reinforcement edge and the support edge cross each other at a point corresponding to a side of a wearer of the brassiere under the arm of the wearer.

18. A brassiere comprising:

a pair of breast cups comprising a first breast cup and a second breast cup, the first breast cup being attached to the second breast cup at a central link;

a pair of lateral bands comprising a first lateral band connected to an outer side of the first breast cup and a second lateral band connected to an outer side of the second breast cup, the first lateral band configured to connect to the second lateral band at a central rear hook;

a pair of straps comprising a first strap connected to an upper part of the first breast cup and a second strap connected to an upper part of the second breast cup;

a pair of interior reinforcement edges comprising a first interior reinforcement edge extending from the first strap along an upper contour of the first breast cup to the central link, and a second interior reinforcement edge extending from the second strap along an upper contour of the second breast cup to the central link;

a pair of exterior reinforcement edges comprising a first exterior reinforcement edge extending from the first strap along an upper contour of the first lateral strap to the central rear hook, and a second exterior reinforcement edge extending from the second strap along an upper contour of the second lateral strap to the central rear hook;

a pair of support edges comprising a first support edge extending from below the first breast cup outwardly and upwardly to a first rear attachment point of the first strap, the first support edge forming an upper contour of a first support panel separate from the first lateral band, and a second support edge extending from below the second breast cup upwardly and outwardly to a second rear attachment point of the second strap, the second support edge forming an upper contour of a second support panel separate from the second lateral band.

19. The brassiere according to claim 18, comprising a lower reinforcement edge lining a lower edge of the pair of lateral bands.

20. The brassiere according to claim 19, wherein the lower reinforcement edge further lines a lower edge of the first support panel and a lower edge of the second support panel.

21. The brassiere according to claim 18, wherein the first support edge further extends from the first rear attachment point to the central rear hook, and the second support edge further extends from the second rear attachment point to the central rear hook.

22. The brassiere according to claim 18, wherein the first support edge and the first support panel are disposed on an outer side of the first lateral band, and the second support edge and the second support panel are disposed on an outer side of the second lateral band.

23. The brassiere according to claim 18, wherein the first interior reinforcement edge meets the second interior reinforcement edge at the central link in a parallel orientation.

24. The brassiere according to claim 18, wherein the first interior reinforcement edge extends toward and at least partially under the second breast cup, and the second interior reinforcement edge extends toward and at least partially under the first breast cup, where the first interior reinforcement edge and the second interior reinforcement edge cross over each other at the central link.

25. The brassiere according to claim 24, wherein the pair of interior reinforcement edges cross over each other at an angle of about 90 degrees.

26. The brassiere according to claim 18, comprising a surface layer of silicone on fabric of the brassiere.

27. The brassiere according to claim 18, wherein the first exterior reinforcement edge and the first support edge cross each other at a first point corresponding to a first side of a wearer of the brassiere under a first arm of the wearer, and the second exterior reinforcement edge and the second support edge cross each other at a second point corresponding to a second side of the wearer of the brassiere under a second arm of the wearer.

* * * * *